US006481825B1

(12) United States Patent
Hinami et al.

(10) Patent No.: US 6,481,825 B1
(45) **Date of Patent: *Nov. 19, 2002**

(54) RECORDING HEAD CAP ARRANGEMENT

(75) Inventors: Jun Hinami, Yokohama; Masataka Eida, Toride, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/265,817

(22) Filed: Mar. 10, 1999

(30) Foreign Application Priority Data

Mar. 11, 1998 (JP) ..... 10-059719
Jan. 20, 1999 (JP) ..... 11-011755

(51) Int. Cl.[7] ..... B41J 2/165
(52) U.S. Cl. ..... 347/29
(58) Field of Search ..... 347/29, 31, 33, 347/32; 400/702 D; 502/302–303, 30, 35, 22, 24, 26, 43–44, 36, 60, 90

(56) References Cited

U.S. PATENT DOCUMENTS 4,429,088 A * 1/1984 Nakahira ..... 524/302
4,855,764 A * 8/1989 Humbs et al. ..... 347/31
5,331,385 A * 7/1994 Ohtsuka et al. ..... 355/290
5,635,965 A * 6/1997 Purwins et al. ..... 347/31
5,847,736 A * 12/1998 Kanbayashi et al. ..... 347/89
5,850,238 A * 12/1998 Karita et al. ..... 347/29
5,978,635 A * 11/1999 Azuma et al. ..... 399/283
6,035,171 A * 3/2000 Takaya et al. ..... 399/281
6,102,533 A * 8/2000 Nozawa et al. ..... 347/86

FOREIGN PATENT DOCUMENTS

JP 3-234659 10/1991 ..... B41J/2/175
JP 403227647 A * 10/1991 ..... 347/31
JP 4-10940 1/1992 ..... B41J/2/05
JP 4-10941 1/1992 ..... B41J/2/05
JP 4-247954 9/1992 ..... B41J/2/165

* cited by examiner

*Primary Examiner*—John Barlow
*Assistant Examiner*—K. Feggins
(74) *Attorney, Agent, or Firm*—Fitzpatrick, Cella, Harper & Scinto

(57) ABSTRACT

Disclosed are a recording head cap to be mounted on a liquid-discharging recording head so as to protect an orifice-disposed face of the recording head, and a method and device for mounting the cap on the recording head. The recording head cap has a solid elastic member for pressing the orifice-disposed face when the cap is mounted on the recording head. The solid elastic member has an ultralow sponge hardness, and allows the orifice-disposed face of the recording head to be pressed with a substantially constant and uniform pressing force without being deformed, and to be thereby reliably protected during prolonged storage without causing ink leakage.

11 Claims, 7 Drawing Sheets

RECORDING HEAD CAP ARRANGEMENT

BACKGROUND OF THE INVENTION

1. Field of the Invention

The present invention relates to a recording head cap for sealing an ink discharge orifice of an inkjet recording head, a recording head having the cap mounted thereon, and a method and device for mounting the cap on the recording head. More particularly, the present invention relates to a cap for a recording head that is detachable from a main body of an apparatus.

2. Description of the Related Art

In a recording head that is detachable from an inkjet recording apparatus, as a means (head protecting member) for protecting an orifice-disposed face of the recording head during prolonged storage for transportation or for other purposes, a head-protecting adhesive seal to be bonded to the orifice-disposed face, and a head-protecting elastic cap to be pressed against a row of discharge orifices, are well known. These head protecting members are necessary to protect the orifice-disposed face without causing ink leakage, even when impacts and vibrations are applied from the outside during transportation and storage, or when the environmental temperature varies.

For example, Japanese Patent Laid-Open No. 3-234659 discloses a recording head cap to be mounted on a head cartridge having a combination of an ink reservoir and a recording head, the recording head cap including an engaging section for engaging with the recording head to combine the head cartridge and the cap; a flexible sheet bonded into contact with a discharge orifice of the recording head and an air communicating opening of the ink reservoir; and an elastic member made of sponge or the like and provided at the portion of the flexible sheet corresponding to the discharge orifice.

Furthermore, Japanese Patent Laid-Open No. 4-247954 discloses a recording head cap including an elastically transformable contact member to be in contact with the orifice-disposed face of a recording head, and a pressing means for pressing the contact member against the orifice-disposed face when the cap is mounted on the recording head. The contact member presses the discharge orifice and the neighborhood thereof along the shape of the orifice-disposed face. Examples of materials for the contact member are rubber, thermoplastic elastomer, and the like, which satisfy the requirements of a rubber hardness (JIS A) of 80 degrees or less in order to achieve a satisfactory airtight condition.

The above-described caps are already in practical use as head protecting members for conventional recording heads, and are satisfactory in the present circumstances.

In recent years, however, inkjet recording apparatuses have been required to achieve photographic high-quality and high-definition. For this reason, recording heads also must, for example, have increased orifice density and reduced orifice diameter.

As the results of examination, the present inventors and others have found that the following problems sometimes arise when the conventional head protecting member is used for a recording head that produces high quality and high definition.

That is, since such a recording head has a more complicated structure than the conventional head, the orifice-disposed face thereof is likely to be deformed when a strong force is applied thereto. For this reason:

(1) In the case of a head protecting seal that is adhesive on the side in contact with the orifice-disposed face, there is a risk that the orifice-disposed face will be damaged by the adhesive force of the seal.

(2) In the case of a head protecting cap in which an elastic member of rubber is pressed against the discharge orifices, since the elastic force of such a conventional rubber member causes strong impact resilience, this may deform the orifice-disposed face.

In both the above cases, high-quality and high-definition recording may be impossible.

Although a head protecting cap using a sponge of a urethane foam as an elastic member will not damage the orifice-disposed face of the recording head, the following problems sometimes arise:

Since the pore diameter of the sponge is large (approximately 40 to 70$\mu$), the pressing force is apt to be nonuniform. Furthermore, as the storage time becomes prolonged, the sponge undergoes creep deformation, has decreased impact resilience, and is thereby made unable to press the orifice-disposed face with a proper pressing force. At worst, there is a risk that the elastic member cannot cover the orifice-disposed face.

SUMMARY OF THE INVENTION

It is accordingly an object of the present invention to address the above problems by making an elastic member in a head protecting cap of a new material that has not previously been used for the elastic member.

It is another object of the present invention to provide a new method of mounting a cap member on a recording head, in connection with the above object or independently, and to more effectively prevent ink from leaking from an orifice-disposed face of the recording head.

In achieve the above objects, according to an aspect of the present invention, there is provided a recording head cap including a solid elastic member for pressing an orifice-disposed face of a recording head, and an engaging section for pressing the solid elastic member against the orifice-disposed face and engaging with the solid elastic member to combine the recording head cap and the recording head, wherein the sponge hardness of the solid elastic member is 10 to 40 degrees, and the repulsive load of the elastic member is damped by 20% or less under compressive elastic deformation of 10 to 60% to be 3 gf/mm$^2$ or more after damping.

According to the above construction, the orifice-disposed face of a high-quality and high-definition recording head, which is structurally apt to deform, is not deformed when pressed by the elastic member. In addition, by using a solid elastic member instead of a porous member such as a sponge, the pressing force against the orifice-disposed face is made uniform, and creep deformation and change in pressing force are restricted during prolonged storage. Therefore, it is possible to provide a head protecting cap capable of protecting the orifice-disposed face of the recording head, which is structurally apt to deform, during prolonged storage. As a specific example of the solid elastic member that satisfies the above features, silicone rubber is given.

Preferably, the solid elastic member is provided with a projection of nearly semicircular cross section that is formed parallel to a row of discharge orifices arranged on the orifice-disposed face of the recording head. This allows the orifice-disposed face to be sealed more reliably. In particular, when the recording head has a plurality of groups of discharge orifices that are able to discharge different liquids, it is preferable that the solid elastic member have projections of nearly semicircular cross section formed parallel to the row direction of the plurality of groups of discharge orifices.

Furthermore, when a flexible film, which is not adhesive to the orifice-disposed face, is provided on the surface of the solid elastic member, the solid elastic member can be made of a material that is difficult to use because of storage stability with respect to ink, thereby widening the choice of materials of the solid elastic member. An area of the solid elastic member in contact with the orifice-disposed face may be coated with a water repellent.

The recording head cap of the present invention is particularly suitable for a high-quality and high-definition recording head, and more particularly, for a recording head in which a surface having energy generating elements for discharging ink opposes the orifice-disposed face.

According to another aspect of the present invention, there is provided a cap mounting method of mounting a cap on a recording head having a discharge orifice for discharging liquid for recording so as to protect an orifice-disposed face of the recording head, including the steps of drawing a flexible film onto the surface of the cap, and mounting the cap with the flexible film drawn thereon onto the recording head so that the flexible film is in contact with the orifice-disposed face.

According to the above-described mounting method, if the surface of the cap in contact with the head is uneven, the flexible film can be easily made to conform to the shape of the cap surface by drawing the flexible film onto the cap. As a result, it is possible to further effectively prevent ink from leaking from the orifice-disposed face of the recording head.

The sponge hardness mentioned in the present invention is obtained by the Asker C hardness measuring method.

Further objects, features and advantages of the present invention will become apparent from the following description of the preferred embodiments with reference to the attached drawings.

DESCRIPTION OF THE PREFERRED EMBODIMENTS

The preferred embodiments of the present invention will be described in detail below with reference to the attached drawings.

Figure 1:
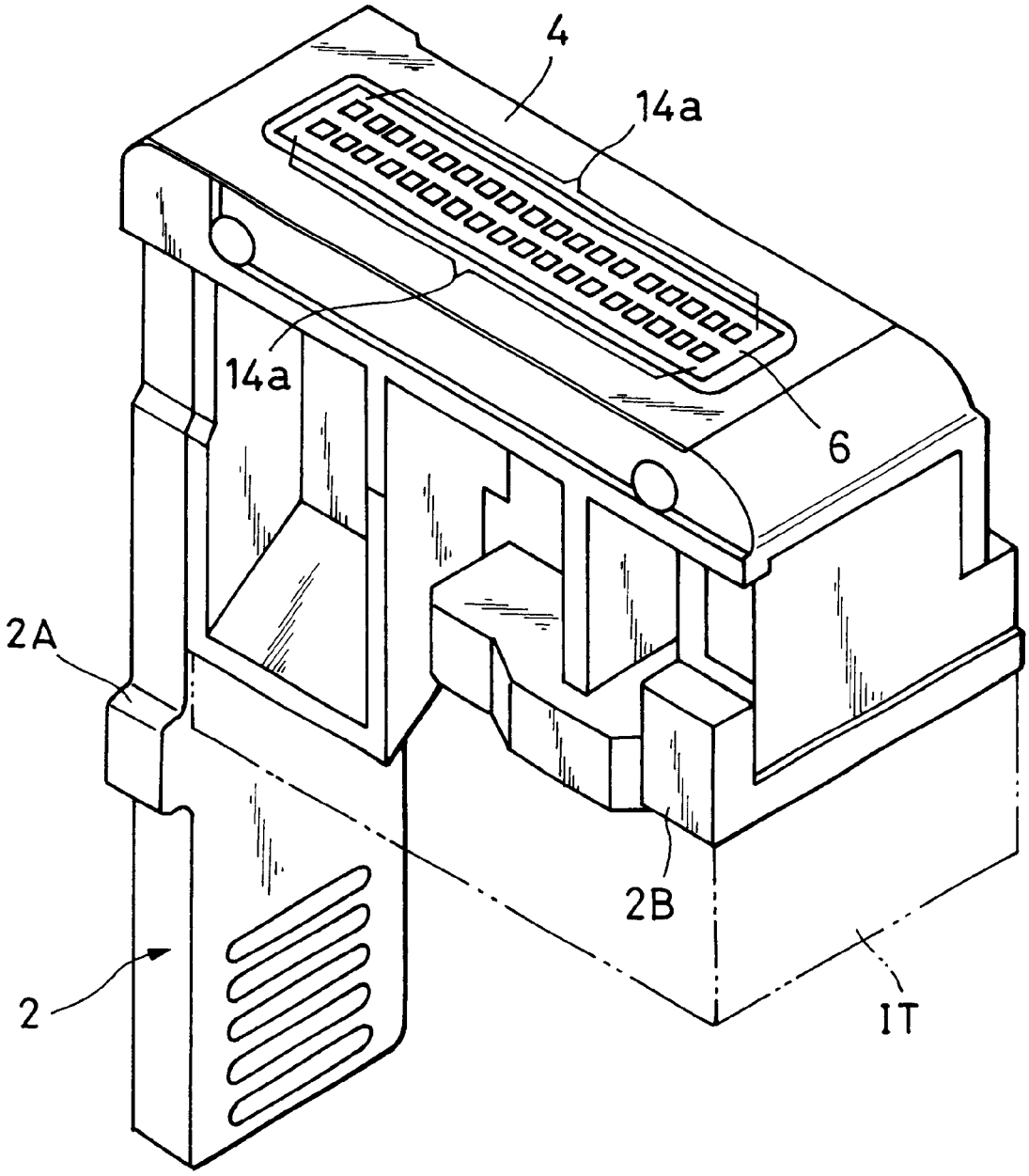
FIG. 1 is a perspective view showing the construction of a recording head that suitably uses a recording head cap of the present invention.

First, a description will be given of an example of a construction of a liquid discharge recording head on which a recording head cap of the present invention is placed, with reference to FIGS. 1 and 2. FIG. 1 is a perspective view of a recording head that suitably uses the recording head cap of the present invention, FIG. 2A is a partially sectional view showing the structure of the recording head shown in FIG. 1, and FIG. 2B is an enlarged sectional view showing the principal part of the structure shown in FIG. 2A.

Figure 2A:
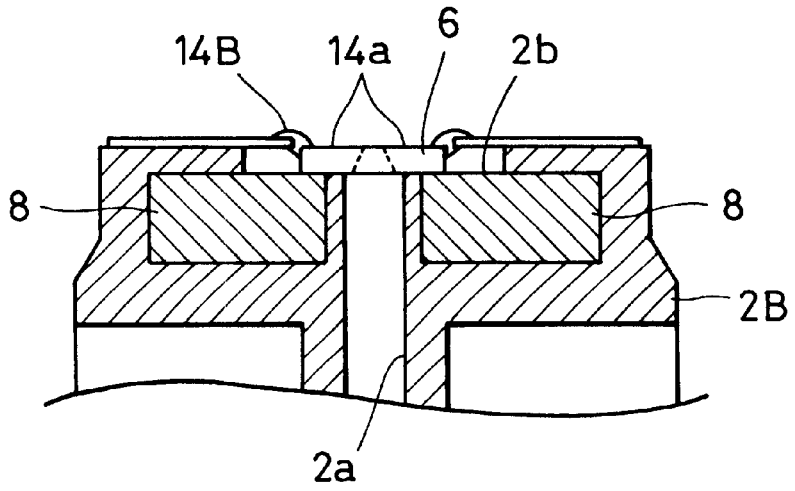
FIG. 2A is a partially sectional view showing the internal structure of the recording head shown in FIG. 1.
Figure 2B:
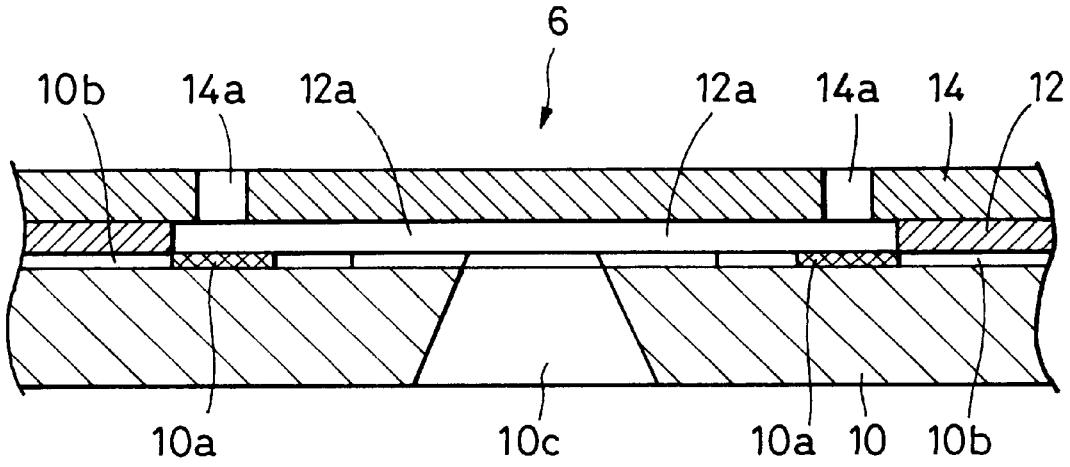
FIG. 2B is an enlarged sectional view showing the principal part of the internal structure shown in FIG. 2A.

The recording head shown in FIGS. 1, 2A, and 2B is of a so-called "side-shooter type" in which an ink orifice-disposed face opposes a face with energy generating elements for discharging ink. Referring to FIG. 1, such a recording head, for example, comprises: a body section 2 composed of an input terminal portion 2A electrically connected to a carriage section of a recording apparatus (not shown) to receive drive control signals from the carriage section, and an ink supply portion 2B on which an ink reservoir IT is mounted; a recording element substrate 6 to be bonded to a joint surface of the ink supply portion 2B in the body section 2; and a printed wiring board 4 electrically connected to the recording element substrate 6 so as to supply the drive control signals from the input terminal portion 2A to the recording element substrate 6.

As shown in FIG. 2A, the ink supply portion 2B of the body section 2 is formed by combining blocks 8 made of an aluminum alloy with resin, and has an ink supply path 2*a* for introducing ink from the ink reservoir IT. One open end of the ink supply path 2*a* is open on a joint surface 2*b* of the ink supply portion 2B, including exposed parts of the blocks 8.

The recording element substrate 6 comprises, as shown in FIG. 2B, a base 10 having an ink supply opening 10*c* that communicates with the open end of the ink supply path 2*a* of the ink supply portion 2B, a partition member 12 for forming a plurality of ink supply branch paths 12*a* corresponding to heaters 10*a* in the base 10 that serve as ink heating portions, and an orifice plate 14 serving as an ink orifice-disposed face in which a plurality of ink discharge orifices 14*a* are arranged in two parallel rows so as to face the heaters 10*a* of the base 10.

The base 10 in the recording element substrate 6 is provided with a thin film made of, for example, a silicone material having a thickness of 0.5 mm to 1.0 mm. Furthermore, the ink supply opening 10*c* extending in the row direction of the ink discharge orifices 14*a* is formed on the surface of the base 10, which is bonded with an adhesive to the joint surface 2*b* of the ink supply portion 2B, so as to face the orifice plate 14.

On both sides of the ink supply opening 10*c* in the base 10, the heaters 10*a* are arranged at predetermined intervals.

The ink supply branch paths 12*a* in the partition member 12 communicate with the ink supply opening 10*c* at one end thereof to lead ink supplied via the ink supply opening 10*c* to the corresponding heaters 10*a*.

A printed wiring board (not shown) is electrically connected to electrodes 10*b* in the base 10 of the recording element substrate 6. The printed wiring board includes a recording element substrate holding portion where the recording element substrate 6 is placed, and a terminal portion located in the input terminal portion 2A of the body section 2.

In the above-described construction, when a drive control signal is supplied to the heaters 10*a* in the base 10 of the recording element substrate 6 via the printed wiring board, the heaters 10*a* generate heat. The ink introduced through the ink supply branch paths 12*a* is thereby heated, and air bubbles are produced by a film boiling phenomenon. As the air bubbles expand, ink is discharged from the ink discharge orifices 14*a* onto a recording surface of a recording medium.

Next, a recording head cap according to a first embodiment of the present invention will be described with reference to FIGS. 3A, 3B, 3C, and 4.

Figure 3A:
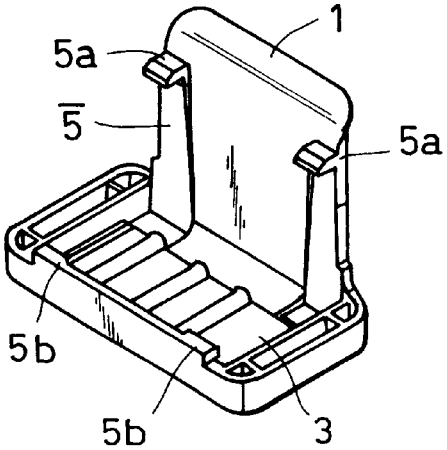
FIG. 3A is a schematic perspective view of a recording head cap according to a first embodiment of the present invention.
Figure 3B:
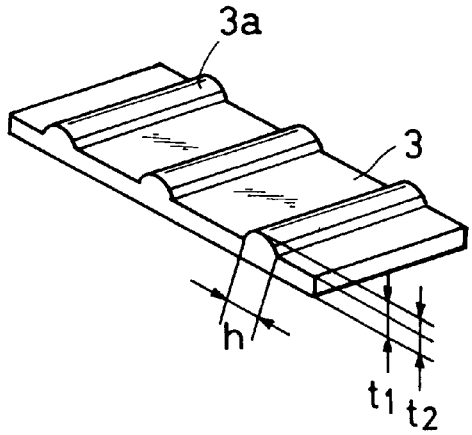
FIG. 3B is a schematic perspective view of a solid elastic member in the cap shown in FIG. 3A.
Figure 3C:
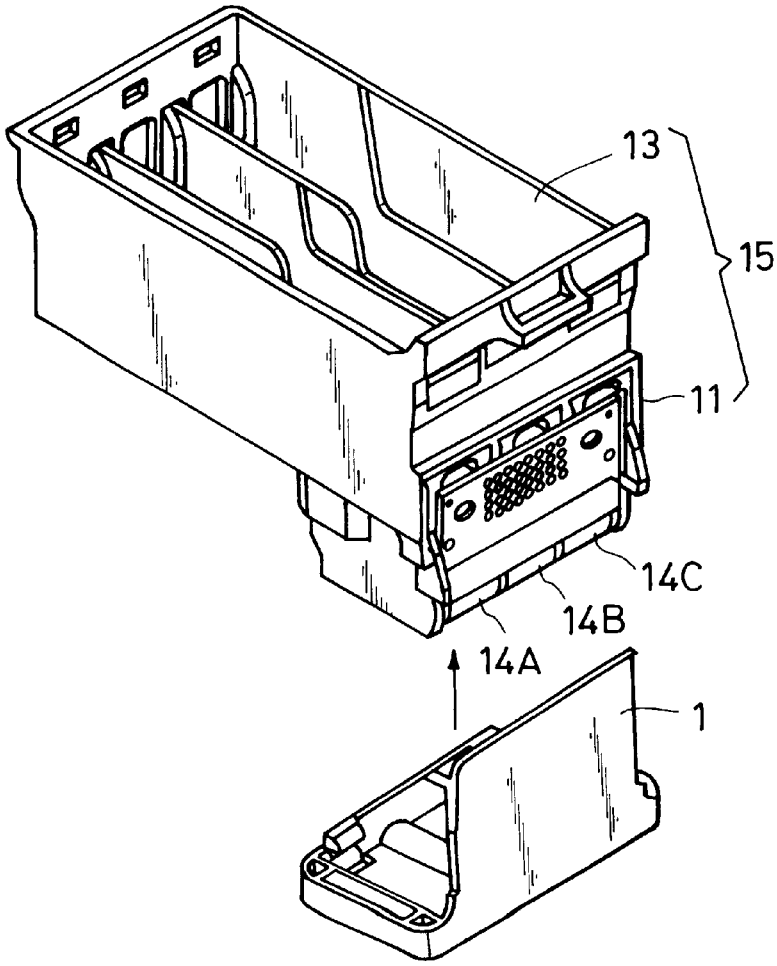
FIG. 3C is a perspective view illustrating the cap and a head cartridge on which the cap is mounted.
Figure 4:
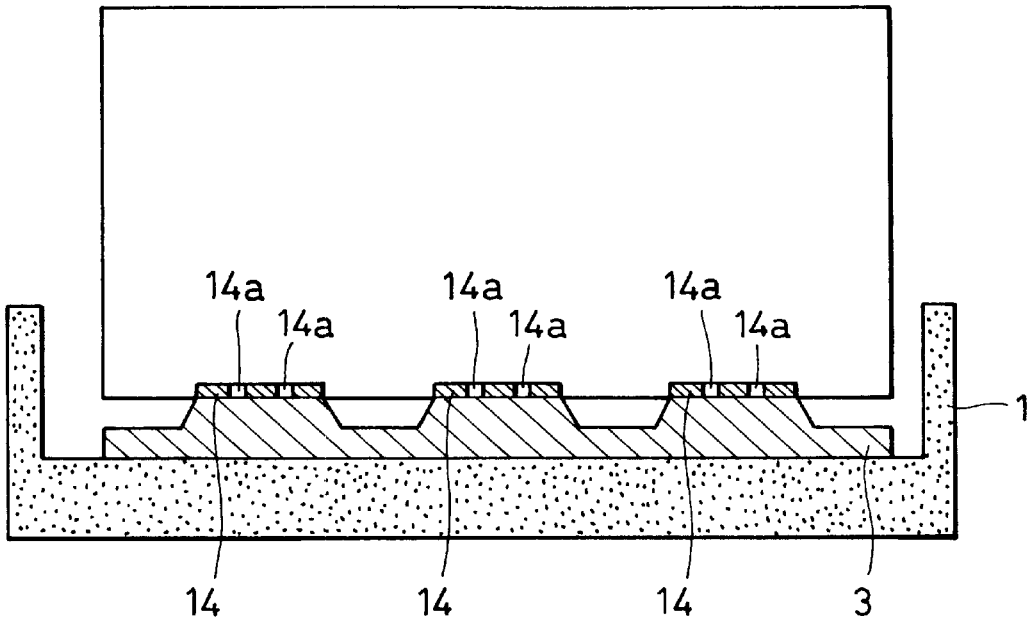
FIG. 4 is a schematic explanatory diagram showing a state in which the cap shown in FIG. 3A is mounted on the recording head.

FIG. 3A is a schematic perspective view of the recording head cap of the first embodiment, FIG. 3B is a schematic perspective view of a solid elastic member in the cap shown in FIG. 3A, FIG. 3C is a perspective view illustrating the cap and a head cartridge on which the cap is mounted, and FIG. 4 is a schematic explanatory diagram showing a state in which the cap shown in FIG. 3A is mounted on a recording head.

Referring to FIG. 3C, a head cartridge 15 includes a liquid-discharge recording head section 11, and an ink reservoir holder 13 having orifice-disposed faces (orifice plates) 14A, 14B, and 14C of the recording head. The liquid-discharge recording head section 11 is equipped with three recording heads of the above-described side shooter type. By loading reservoirs containing inks of different colors in the ink reservoir holder 13, the recording heads are allowed to discharge inks of different colors. In FIG. 3C, discharge orifices of the recording heads are arranged in the same direction as the longitudinal direction of the ink reservoir holder 13.

A head cap 1 to be attached to the head cartridge 15 described above comprises a solid elastic member 3 made of silicone rubber, which will be described later, and an engaging section 5 having engaging claws 5*a* and 5*b* for pressing the solid elastic member 3 against the orifice plates 14A, 14B, and 14C serving as the orifice-disposed faces, and for engaging with the head cartridge (recording head) 15 to combine the head cap 1 and the head cartridge 15.

Now, a detailed description will be given of the hardness and creep property of the solid elastic member employed in the present invention.

The solid elastic member of the present invention exhibits a flexibility which is too high to measure with a rubber hardness tester, and in this embodiment, is made of an ultrahigh-flexibility silicone rubber having a sponge hardness of approximately 10 to 40 degrees measured by the Asker C hardness measuring method. The engaging section is formed by an injection molded piece of polyacetal resin. The silicone rubber member 3 is fixed on the engaging section by a double-faced adhesive tape.

By pressing such an ultralow-hardness solid elastic member against the orifice-disposed face of the recording head by using the engaging section to be elastically deformed, a pressing force of 2 to 16 gf/mm$^2$ with respect to the orifice-disposed face can be produced. Depending on the shape of the recording head, it is desirable that a pressing force of approximately 4 to 8 gf/mm$^2$ be produced, in consideration of deformation, damage, or the like of the orifice-disposed face due to the pressing. In this case, the above desired pressing force can be obtained by elastically deforming the silicone rubber serving as the solid elastic member by 20 to 50%.

In this way, the solid elastic member having an ultralow hardness allows the cap to be in tight contact with, for example, the orifice-disposed face, which is apt to deform, of the recording head shown in FIG. 2, without causing deformation. Accordingly, the use of the cap of the present invention makes it possible to reliably seal the orifice-disposed face of the recording head without allowing ink to leak from the recording head even when impacts occur due to falling, vibration, or for other reasons, or when environmental conditions, such as temperature and atmospheric pressure, vary.

Furthermore, the solid elastic member having a low sponge hardness in this embodiment has an advantage of less change in pressing force due to the dimensional tolerance between the engaging section and the recording head, compared with a normal elastic member that can be measured with the rubber hardness tester, whereby the orifice-disposed face can be reliably protected with a small pressing force.

In particular, the solid elastic member 3 in this embodiment is provided with projections 3*a* of semicircular cross section that extend parallel to the discharge orifice rows at the positions in contact with the orifice-disposed faces 14A, 14B, and 14C of the recording heads, thereby reliably and tightly sealing the discharge orifices on the orifice-disposed faces 14A, 14B, and 14C. Such projections are more suitable, for example, for the recording head shown in FIG. 2 in which the discharge is recessed from the peripheral portion, because other parts of the recording head are prevented from being unnecessarily pressed. Of course, whether the solid elastic member is provided with such projections or remains flat may be appropriately selected depending on the shape of the recording head. For example, the solid elastic member may be flat when pressing a single head because this will not result in accuracy problems, which may arise in a head cartridge composed of a combination of a plurality of heads, such as when there are manufacturing variations in the combination of the heads.

On the other hand, the ultrahigh-flexibility silicone rubber of this embodiment also has excellent creep property (the damping property of repulsive load at the time of compressive deformation). Tests were made of the change of repulsive force of solid elastic members having the same shape as that shown in FIG. 3B (t1=0.6 mm, t2=1.4 mm, h=3.0 mm), one of the solid elastic members being molded from polyurethane sponge (Comparative Example 1) and the other being molded from polyurethane elastomer (Comparative Example 2). Table 1 shows the test results.

TABLE 1

| | Change in Repulsive Load over Time (Units: gf/mm$^2$) | | | | |
|---|---|---|---|---|---|
| | 0 h (initiation) | 100 h | 500 h | 1000 h | 2000 h |
| Embodiment | 4.0 | 3.8 | 3.7 | 3.7 | 3.8 |
| Comparative Example 1 | 10.0 | 5.4 | 4.5 | 4.0 | 3.7 |

TABLE 1-continued

| | Change in Repulsive Load over Time (Units: gf/mm$^2$) | | | | |
|---|---|---|---|---|---|
| | 0 h (initiation) | 100 h | 500 h | 1000 h | 2000 h |
| Comparative Example 2 | 7.5 | 5.8 | 5.2 | 5.0 | 4.8 |

As the result of the test of the creep property of the elastic member of polyurethane sponge (Comparative Example 1) and the elastic member of polyurethane elastomer (Comparative Example 2), the repulsive force shows a tendency to rapidly damp from the initial value and to subsequently damp more slowly with the passage of time, as is apparent from Table 1. In contrast, the repulsive force of the ultrahigh-flexibility silicone rubber in the present invention is not significantly damped, and remains stable.

Hitherto, in the case in which the elastic member is made of polyurethane sponge or the like, there is a need to set the initial pressing force against the orifice-disposed face higher than required, in consideration of the above-described damping property, which may cause damage to the orifice-disposed face. By using the solid elastic member of ultrahigh-flexibility silicone rubber of the present invention, however, it is possible to limit the damping of repulsive load over time after compressive deformation, and to stably seal and protect the orifice-disposed face during prolonged storage.

As described above, in order to stably seal and protect the orifice-disposed face during prolonged storage, it is preferable that the repulsive load of the elastic member be damped by 20% or less under compressive elastic deformation of 10 to 60% to be 3 gf/mm$^2$ or more after damping, as in the elastic member of silicone rubber in this embodiment.

Next, a description will be given of a second embodiment of the present invention.

Figure 5:
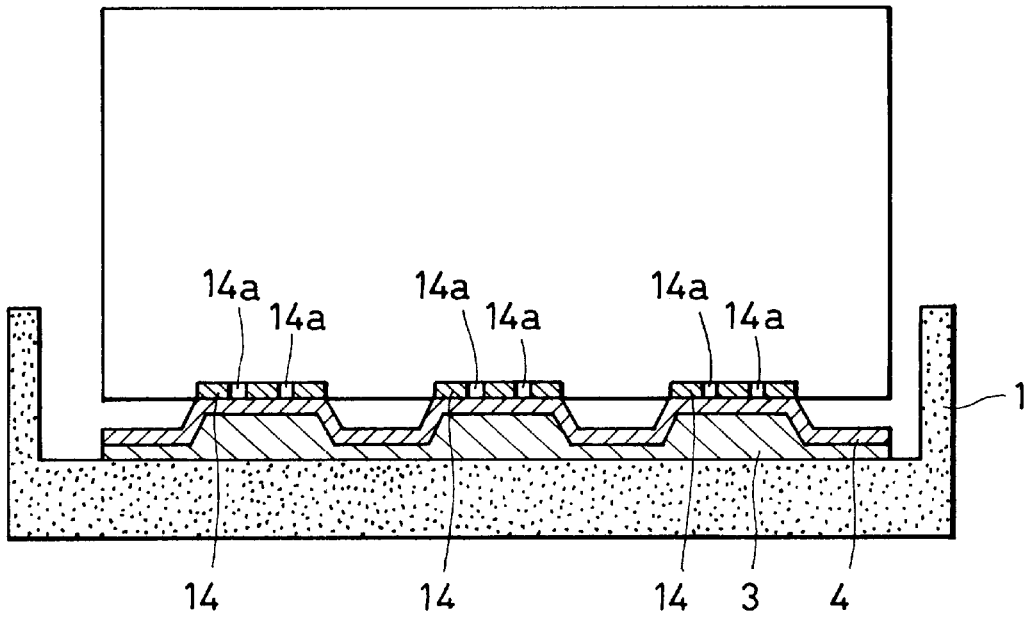
FIG. 5 is a schematic explanatory diagram showing a recording head cap according to a second embodiment of the present invention.

FIG. 5 is an explanatory view showing a recording head cap according to the second embodiment of the present invention, corresponding to FIG. 4 illustrating the above-described first embodiment. This embodiment differs from the first embodiment in that a flexible film 4 is provided on the side of a solid elastic member in contact with an orifice-disposed face of a recording head. This flexible film 4 is slightly adhesive on the side in contact with the solid elastic member, and is not adhesive on the side in contact with the orifice-disposed face of the recording head, so that it can be separated from the recording head together with the solid elastic member when the cap is detached from the recording head.

In this embodiment, the solid elastic member can be made of a material which satisfies the requirements, such as for sponge hardness and creep deformation, but which exudes an exudate, such as a softening agent, low-molecular siloxane, or an additive, while being pressed, because the flexible film 4 prevents the exudate from adhering to the orifice-disposed face of the recording head. It is thereby possible to increase the number of kinds of materials that can be used for the solid elastic member.

The flexible film 4 may be made of any material that prevents the above exudate from adhering to the orifice-disposed face and that follows the orifice-disposed face well. Not only a resin material but also a flexible metal, such as an amorphous metal, may be used as long as it does not react with the ink to be used. In general, however, it is preferable to use an olefin resin material in order not to limit the kinds of ink to be used. In this embodiment, a non-oriented polypropylene film having a thickness of 0.1 mm is used as the flexible film.

Figure 6:
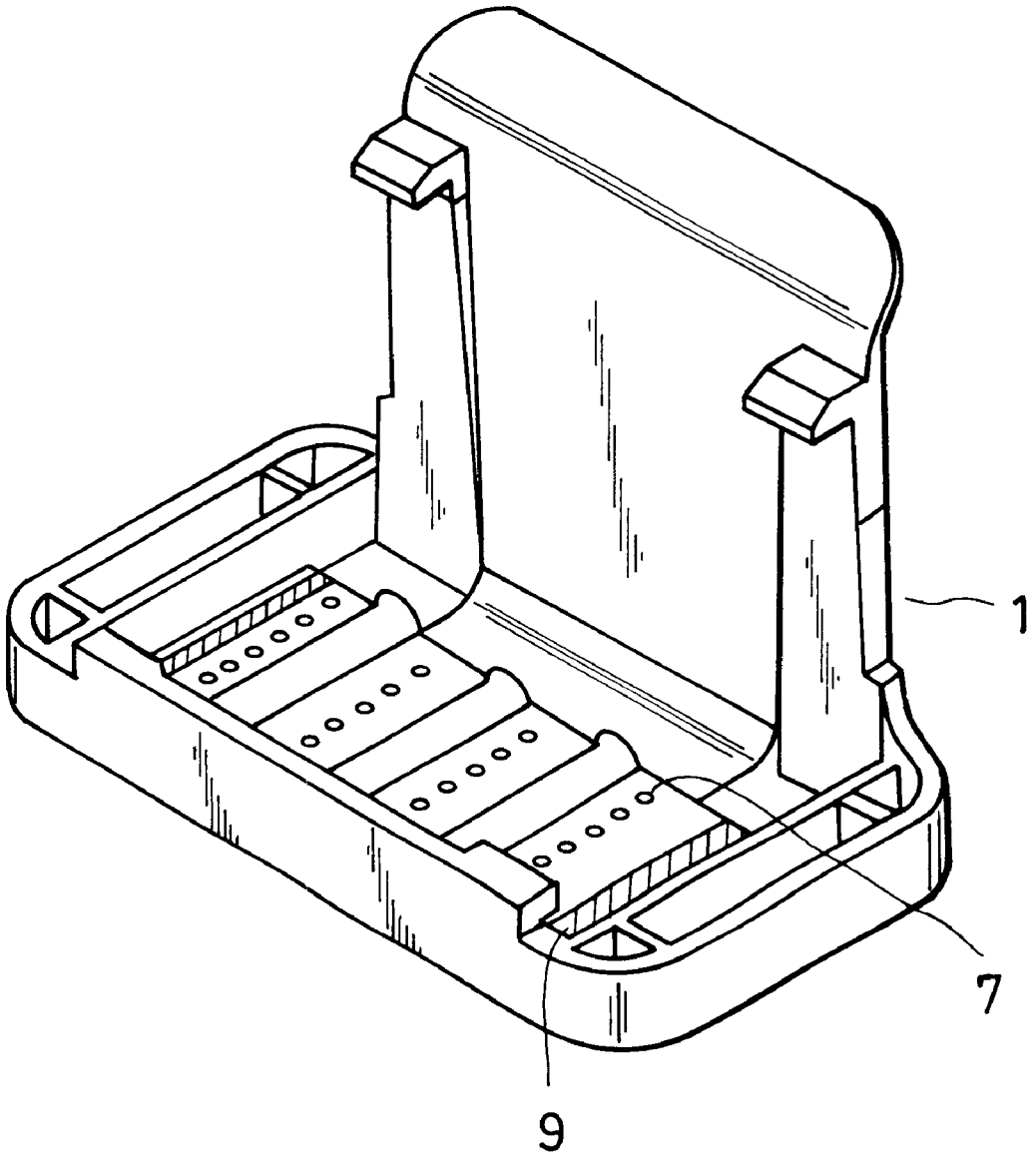
FIG. 6 is a schematic explanatory diagram showing a recording head cap according to a third embodiment of the present invention.

FIG. 6 shows a third embodiment of the present invention. This embodiment differs from the second embodiment shown in FIG. 5 in that adhesive portions 9 are provided at the portions of a flexible film not in contact with the discharge orifice rows (preferably, end portions) and in that through holes 7 are formed in the portions of a solid elastic member other than the portions pressed against the discharge orifice rows. By thus providing the adhesive portions not on the entire surface of the flexible film, but at the portions not in contact with the discharge orifice rows, it is possible to prevent the discharge of the recording head from being damaged when the flexible film is peeled off, and to more effectively prevent ink filled inside the recording head from leaking from the orifice-disposed face of the recording head.

In the case in which the elastic member for pressing the orifice-disposed face of the recording head has an uneven shape, as in the present invention, it is difficult to cause the above-described film to follow the shape of the elastic member. Accordingly, in this embodiment, the film is made to conform to the shape of the solid elastic member in a method shown in FIGS. 7A, 7B, and 7C.

Figure 7A:
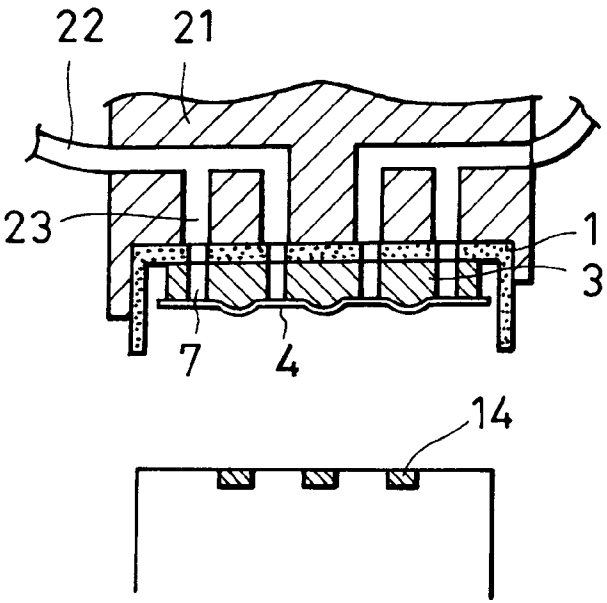
FIGS. 7A, 7B, and 7C are explanatory views illustrating an example of a method of mounting the cap shown in FIG. 6 on the recording head.
Figure 7B:
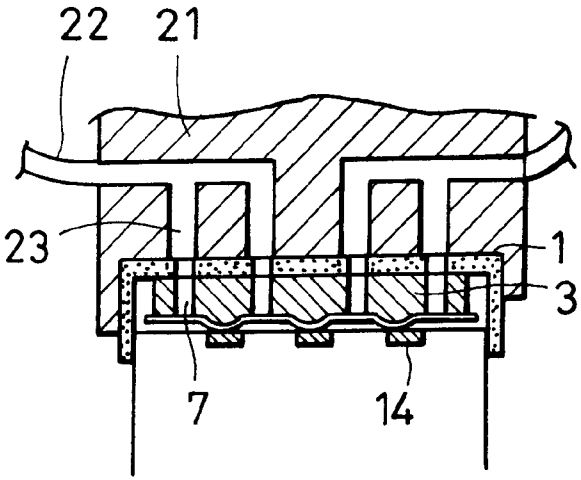
Figure 7C:
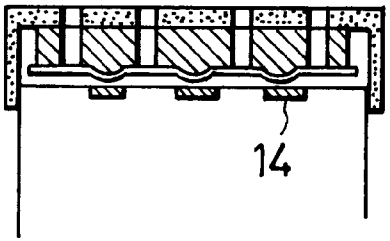

FIGS. 7A, 7B, and 7C illustrate a time sequence example of a mounting method of mounting the cap, shown in FIG. 6, on the recording head. First, the cap member 1 is held by a mounting jig 21, and the through holes 7 are aligned with vacuum holes 23 of the mounting jig 21, as shown in FIG. 7A. After that, the flexible film 4 is brought into contact with the solid elastic member 3, and is drawn by vacuum tubes 22 connected. to a vacuum pump or the like, which is not shown, to be held on the solid elastic member 3. The cap member 1 is then mounted on the recording head, as shown in FIG. 7B. After the completion of mounting, the drawing operation is stopped, and the mounting jig 21 is removed, as shown in FIG. 7C.

By doing this, it is possible to easily cause the film to conform the shape of the solid elastic member, and to more effectively prevent ink filled inside the recording head from leaking from the orifice-disposed face of the head.

Figure 8:
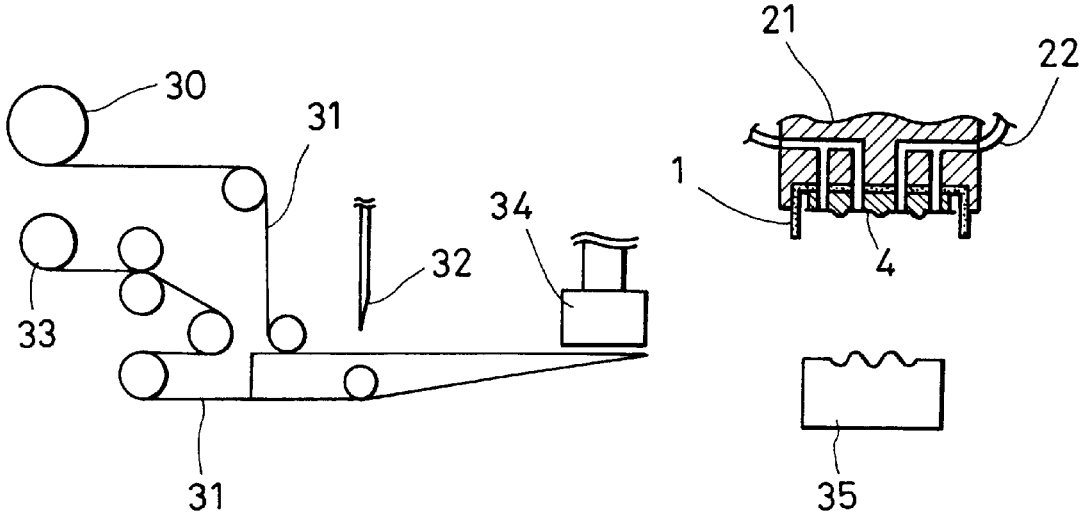
FIG. 8 is an explanatory view illustrating an example of a mounting device for carrying out the mounting method shown in FIGS. 7A to 7C.

FIG. 8 shows an example of a device for carrying out the above-described mounting method. In FIG. 8, numerals 21 and 35 denote the above-described mounting jig, and a transforming base having the external shape corresponding to the surface shape of the solid elastic member, respectively. A flexible film is combined with a parting tape into a roll 30, and is fixed to the device. The parting tape is delivered by a motor 33 at a required length, and only the flexible film is cut to a predetermined length with a cutting blade 32. The cut flexible film is conveyed onto the transforming base 35 by a conveyor device 34, and the transforming base 35 makes contact with the mounting jig 21 holding the cap 1, whereby the drawing operation shown in FIG. 7A is performed. FIG. 8 shows the state after the drawing operation.

Figure 9:
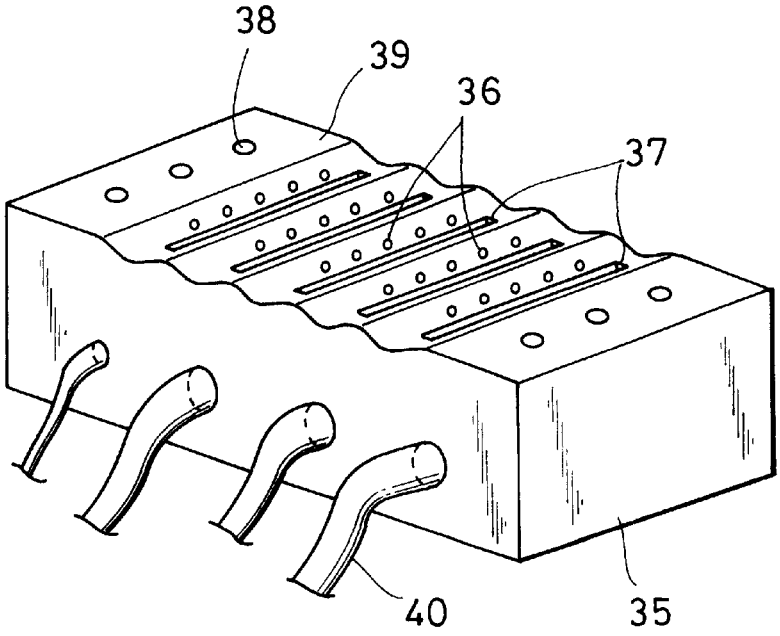
FIG. 9 is a schematic perspective view of a transforming base in the mounting device shown in FIG. 8.

The above-described transforming base 35 will now be described with reference to FIG. 9. It is preferable that the transforming base 35 have a shape corresponding to the surface shape of the solid elastic member so that the flexible film reliably adheres onto the cap and is held thereon. Furthermore, the transforming base 35 may be provided with vacuum holes 36 to 38, and may draw the flexible film conveyed from the conveyor means 34 by using vacuum tubes 40, as shown in FIG. 9. Since such a drawing operation allows the shape of the flexible film to previously follow the surface shape of the solid elastic member with which the flexible film is in contact, it is possible to further enhance the above-described advantages. When the adhesive portions 9 are provided at the ends of the film as in this embodiment, even if the adhesive portions 9 have a relatively high adhesion, the film can be promptly peeled from the transforming base 35 in the drawing operation by subjecting portions 39 of the transforming base 35 in contact with the adhesive portions 9 to Teflon coating and graining. During the drawing of the film onto the cap, a small amount of gas may be injected from the vacuum holes 36 to 38 of the transforming base 35 to aid the drawing.

The above-described drawing operation is effective, particularly in the case in which the film surface in contact with the solid elastic member is not adhesive. For such a cap mounting method itself using the film and the solid elastic member, the solid elastic member need not have the repulsive load described above, and ink leakage from the orifice-disposed face of the recording head can be prevented by reliably, instantaneously, and simultaneously capping a plurality of discharge orifices, provided that the above advantages can be synergistically enhanced by using a solid elastic member having the repulsive load in the range defined in the above embodiment.

While the drawing is performed using air in the above embodiment, it may be performed by electrostatic charging when the flexible film and the solid elastic member have the property of being electrostatically charged. Instead of such a flexible film, a resin layer may be provided on the portion of the solid elastic member in contact with the orifice-disposed face by coating or by other methods.

By applying a water repellent onto the solid elastic member or the flexible film in contact with the orifice-disposed face, it is possible to prevent ink leakage due to a capillary phenomenon when there is a gap between the orifice-disposed face and the cap.

While the solid elastic member and the engaging section are bonded with a double-faced adhesive tape or the like in the embodiment of the present invention, they may be integrally formed by two-color molding. Furthermore, when the parts constituting the recording head cap of the present invention, such as the solid elastic member, the engaging section, and the flexible film, are molded from similar materials such as olefin resins (e.g., polyethylene and polypropylene), they need not be disassembled when disposed of, and can be easily recycled.

The recording head cap described in the above embodiments can be suitably used for a recording head of a so-called "side-shooter type", and in particular, is more effective for a side-shooter type recording head that uses the liquid discharge method disclosed in Japanese Patent Laid-Open No. 4-10940 or 4-10941. Of course, the recording head cap of the present invention is also applicable to a recording head of a so-called "edge-shooter type" in which discharge orifices are formed at the end of a liquid path extending along the surface having heat-generating resistive elements.

As described above, according to the present invention, since a recording head cap uses an ultralow-hardness solid elastic member, it is able to be in tight contact with the orifice-disposed face of a recording head, which is apt to deform, without causing deformation over a prolonged period.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording head cap for capping an orifice plate of an ink jet recording head, which have a plurality of orifices on said orifice plate, during transportation and storage of said ink jet recording head, said recording head cap comprising:

a solid elastic member for pressing an orifice-disposed face of a recording head; and an engaging section for pressing said solid elastic member against said orifice-disposed face and combining said solid elastic member with said recording head, wherein said orifice-disposed face is a flat plane, and wherein the hardness of said solid elastic member is 10 to 40 degrees as measured by an Asker C sponge hardness tester, and the repulsive load of said solid elastic member is damped by 20% or less under compressive elastic deformation of 10 to 60% to be 3 gf/mm$^2$ or more after damping, so that said elastic member seals said plurality of orifices by the contact of said solid elastic member and said orifice-disposed face.

2. A recording head cap according to claim 1, wherein said solid elastic member comprises silicone rubber.

3. A recording head cap according to claim 1, wherein said solid elastic member has a projection of nearly semicircular cross section that is formed parallel to a row of discharge orifices arranged on said orifice-disposed face of said recording head.

4. A recording head cap according to claim 1, wherein said recording head has a plurality of groups of discharge orifices that are able to discharge different liquids, and said solid elastic member has projections of nearly semicircular cross section, each of the projections formed parallel to and corresponding to one of the said plurality of groups of discharge orifices.

5. A recording head cap according to claim 1, wherein said solid elastic member and said engaging section are integrally formed by two-color molding.

6. A recording head cap according to claim 1, wherein a flexible film is provided on a surface of said solid elastic member, and a surface of said flexible film opposing said orifice-disposed face is not adhesive with respect to said orifice-disposed face.

7. A recording head cap according to claim 1, wherein a through hole is formed in a portion of said solid elastic member that is not in contact with a row of discharge orifices.

8. A recording head cap according to claim 1, wherein an area of said solid elastic member in contact with said orifice-disposed face is coated with a water repellent.

9. A recording head cap according to claim 1, further comprising a face having an energy generating element for discharging ink, the face being opposed to said orifice-disposed face.

10. A recording head with a recording head cap detachably mounted thereon, comprising:

an electrothermal conversion element using heat energy as an energy-generating element for discharging ink;

a flat plane orifice-disposed face provided with a plurality of orifices for ejecting said ink;

a solid elastic member for pressing an orifice-disposed face of a recording head; and an engaging section for pressing said solid elastic member against said orifice-disposed face and combining said solid elastic member with said recording head, wherein the hardness of said solid elastic member is 10 to 40 degrees as measured by an Asker C sponge hardness tester, and the repulsive load of said solid elastic member is damped by 20% or less under compressive elastic deformation of 10 to 60% to be 3 gf/mm$^2$ or more after damping, so that said elastic member seals said plurality of orifices by the contact of said solid elastic member and said orifice-disposed face.

11. A recording head cap for capping an orifice plate of an ink jet recording head, said orifice plate having a plurality of orifices, during transportation and storage of said ink jet recording head, said recording head cap comprising:

a solid elastic member for pressing an orifice-disposed face, wherein said orifice-disposed face is a flat plane, and wherein the hardness of said solid elastic member is 10 to 40 degrees as measured by an Asker C sponge hardness tester, and the repulsive load of said solid elastic member is damped by 20% or less under compressive elastic deformation of 10 to 60% to be 3 gf/mm$^2$ or more after damping, so that said elastic member seals said plurality of orifices by the contact to said solid elastic member and said orifice-disposed face.

* * * * *

UNITED STATES PATENT AND TRADEMARK OFFICE

CERTIFICATE OF CORRECTION

PATENT NO. : 6,481,825 B1
DATED : November 19, 2002
INVENTOR(S) : Hinami et al.

It is certified that error appears in the above-identified patent and that said Letters Patent is hereby corrected as shown below:

Title page,
Item [56], References Cited, U.S. PATENT DOCUMENTS, "4,429,088" should read -- 4,429,068 --.

Column 2,
Line 36, "achieve" should read -- achieving --.

Column 12,
Line 12, "to" should read -- of --.

Signed and Sealed this

Sixteenth Day of December, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,481,825 B1
DATED : November 19, 2002
INVENTOR(S) : Hinami et al.

It is certified that error appears in the above-identified patent and that said Letters Patent is hereby corrected as shown below:

Column 10,
Line 11, “have” should read -- has --.

Signed and Sealed this

Tenth Day of August, 2004

JON W. DUDAS
*Acting Director of the United States Patent and Trademark Office*